US006042248A

United States Patent [19]

Hannah et al.

[11] Patent Number: 6,042,248

[45] Date of Patent: Mar. 28, 2000

[54] LED ASSEMBLY FOR ILLUMINATED SIGNS

[75] Inventors: Freddie L. Hannah, Claremore; Kevin W. Hannah; G. Robert Preddy, both of Tulsa, all of Okla.

[73] Assignee: Lektron Industrial Supply, Inc., Tulsa, Okla.

[21] Appl. No.: 08/950,478

[22] Filed: Oct. 15, 1997

[51] Int. Cl.[7] ..... G09F 13/28

[52] U.S. Cl. ..... 362/252; 362/249; 362/812; 40/552; 40/551

[58] Field of Search ..... 40/541, 550, 564, 40/580, 552; 362/812, 800, 227, 249, 252, 240, 362, 370, 235

[56] References Cited

U.S. PATENT DOCUMENTS

| | | | |
|---|---|---|---|
| 3,937,384 | 2/1976 | Minogue | 228/120 |
| 4,967,317 | 10/1990 | Plumly | 362/31 |
| 5,016,145 | 5/1991 | Singleton | 362/812 |
| 5,388,357 | 2/1995 | Malita | 40/570 |
| 5,403,207 | 4/1995 | Briones | 439/620 |
| 5,539,623 | 7/1996 | Gurz | 362/20 |
| 5,615,502 | 4/1997 | Gabrius | 40/570 |
| 5,729,925 | 3/1998 | Prothero | 362/812 |

*Primary Examiner*—Thomas M. Sember
*Assistant Examiner*—Marshall Honeyman
*Attorney, Agent, or Firm*—Frank J. Catalano

[57] ABSTRACT

An assembly for illuminating a sign having an enclosure covered by a translucent panel includes a plurality of track molding sections, each having at least one circuit board electrically connecting a plurality of LEDs mounted thereon, integrated into a unitary structure by brackets or a stencil with the molding sections secured in a configuration suitable to be inserted into the enclosure and to illuminate the translucent panel. The unitary structure is secured in the enclosure into which has been inserted by sheet metal screws, epoxy glue, double backed adhesive strips or the like. Preferably, if brackets are used, at least two of the brackets extend to a side wall of the enclosure and a plurality of screws fasten the brackets to the side walls of the enclosure to which they extend. Preferably, each of the circuit boards is electrically connected into a single circuit and a transformer which is secured to one of the brackets or to the stencil has low voltage terminals which are electrically connected to the single circuit. A switch, sometimes part of the sign being illuminated, may be used to electrically connect the high voltage terminals of the transformer to an electrical power source. A housing secured to one of the brackets or to the stencil may be used to cover the transformer. Preferably, if a stencil is used, the stencil is proportionately smaller than the translucent panel and most preferably is formed by use of electronic data defining the configuration of the translucent surface or the enclosure.

4 Claims, 4 Drawing Sheets

LED ASSEMBLY FOR ILLUMINATED SIGNS

BACKGROUND OF THE INVENTION

This invention relates generally to illuminated signs and more particularly concerns an LED assembly for illuminating signs of any size and shape and especially relatively large signs already mounted in locations posing access problems.

Illuminated signs such as those displaying the name, logo or other graphic information identifying a company, goods, services or the like commonly use fluorescent or neon lighting systems contained in an enclosure covered by a translucent panel which is configured, colored or masked to present the desired display. These signs are generally quite large and are mounted in as high a location as possible so as to be visible from great distances. Their power demands result in high electric bills. Each fluorescent or neon lamp is typically large and clumsy to manipulate and requires their own sockets or mounting brackets in the enclosure. The system components alone are generally expensive to replace and the cost of repairs is further exacerbated by the need of a boom truck to do the work. Fluorescent systems require frequent service because of their short life span. Neon systems have a longer life span but a high failure rate and generally require the expertise of a specially trained technician.

LED systems are known to provide long life, low cost lighting. However, their use in illuminated sign applications is presently limited to retrofit kits which are suitable only for relatively small and easily accessible illuminated signs, such as exit signs or the like. In using these kits, the exit lamp internal sockets are fitted with adapters. One or two small sections of LED board track molding are fastened directly to the sign enclosure, typically by use of double backed adhesive strips, and a short length of LED board is mounted in each molding. Plugs on the LED circuits are then mated with the adapters to provide power to the LEDs. Such kits are not suited to the power, illumination and work area requirements of larger or less accessible illuminated signs and, even if the kits could be used with such signs, the time required to do so would be prohibitive.

It is, therefor, an object of this invention to provide an LED assembly suitable for retrofitting all types and sizes of illuminated signs and especially relatively large and inaccessible fluorescent and neon signs. Another object of this invention is to provide an LED assembly suitable for mounting in new illuminated signs of all types and sizes. Still another object of this invention is to provide an LED assembly including all components on the load side of an illuminated sign power switch which can be mounted in or removed from the enclosure of the illuminated sign as a single unit. Yet another object of this invention is to provide a lighting assembly for illuminated signs of all shapes and sizes which has a relatively long life span and low failure rate. It is also an object of this invention to provide a lighting assembly for illuminated signs that can be retrofitted to an existing fluorescent or neon sign without requiring use of a boom truck.

SUMMARY OF THE INVENTION

In accordance with the invention, an assembly is provided for illuminating a sign having an enclosure covered by a translucent panel. A plurality of track molding sections, each having at least one circuit board electrically connecting a plurality of LEDs mounted thereon, are integrated into a unitary structure by brackets or a stencil with the molding sections secured in a configuration suitable to be inserted into the enclosure and to illuminate the translucent panel. The unitary structure is secured in the enclosure into which has been inserted by sheet metal screws, epoxy glue, double backed adhesive strips or the like. Preferably, if brackets are used, at least two of the brackets extend to a side wall of the enclosure and a plurality of screws fasten the brackets to the side walls of the enclosure to which they extend. Preferably, each of the circuit boards is electrically connected into a single circuit and a transformer which is secured to one of the brackets or to the stencil has low voltage terminals which are electrically connected to the single circuit. A switch, sometimes part of the sign being illuminated, may be used to electrically connect the high voltage terminals of the transformer to an electrical power source. A housing secured to one of the brackets or to the stencil may be used to cover the transformer. Preferably, if a stencil is used, the stencil is proportionately smaller than the translucent panel and most preferably is formed by use of electronic data defining the configuration of the translucent surface or the enclosure.

BRIEF DESCRIPTION OF THE DRAWINGS

Other objects and advantages of the invention will become apparent upon reading the following detailed description and upon reference to the drawings in which.

While the invention will be described in connection with preferred embodiments thereof, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 1:
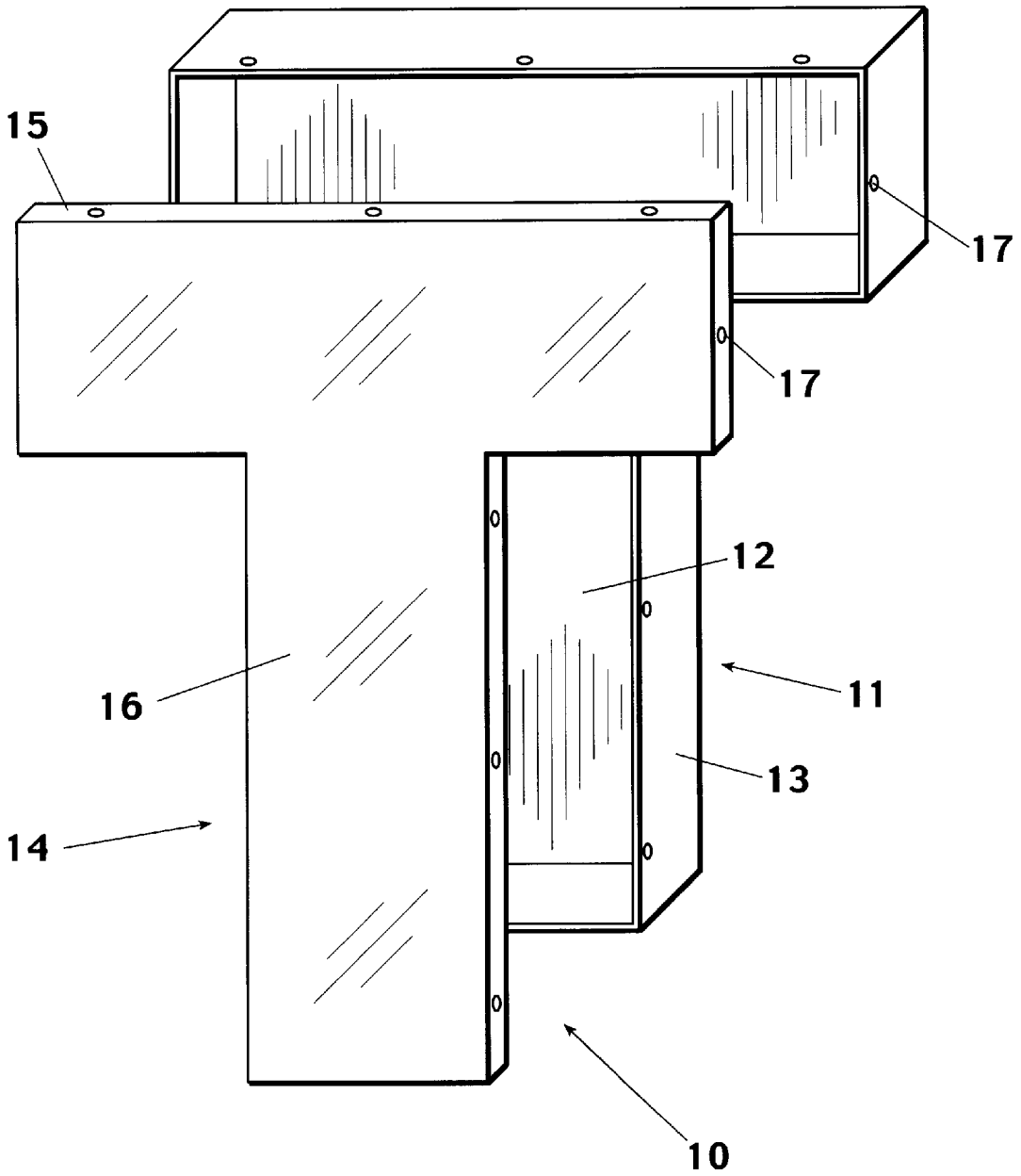
Fig. 1 ( PRIOR ART )
FIG. 1 is a perspective view taken from the front of a typical illuminated sign for use with the present invention.

Turning first to FIG. 1, an illuminated sign 10 in the shape of a letter T is illustrated. The sign 10 has been chosen for descriptive purposes only and is representative of a sign of any desired configuration, whether alpha numeric, graphic or combinations thereof. The sign 10 typically consists of a base enclosure 11 having a back wall 12 and side or peripheral walls 13, all of sheet metal or other suitable material. A translucent cover or lens 14 having side or peripheral walls 15 extending from a front face 16 typically slips over the front of the base enclosure 11. The cover or lens 14 is generally secured in place by the use of sheet metal screws (not shown) in aligned holes 17 in the peripheral walls 13 and 15 of the base enclosure 11 and cover 14, respectively. Many variations of this arrangement are possible. For example, a flat lens may be mounted in a frame which is in turn attached to the base enclosure. The particular configuration is of no significance in the present invention so long as the sign 10 generally includes a base enclosure 11 and a cover 14.

Figure 2:
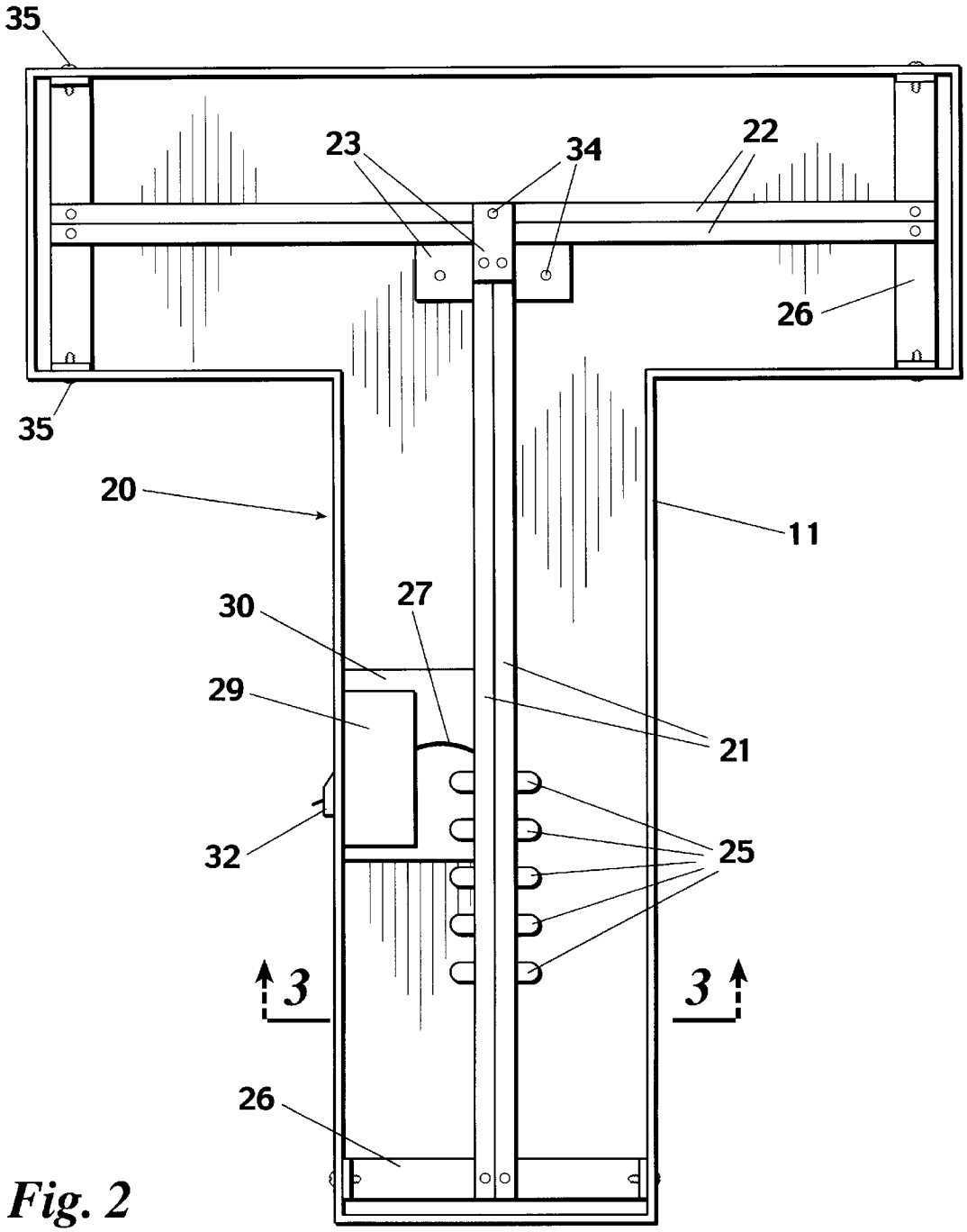
FIG. 2 is a front elevation view of a bracket type embodiment of an LED assembly of the present invention mounted in the base enclosure of the sign of FIG. 1.
Figure 3:
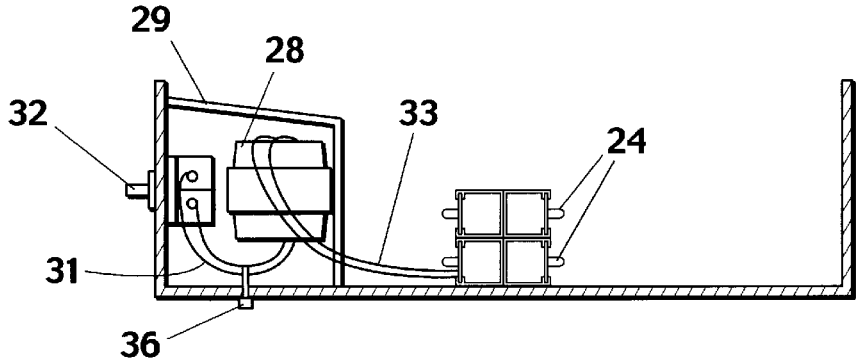
FIG. 3 is a sectional view taken along the line 3—3 of FIG. 2.
Figure 4:
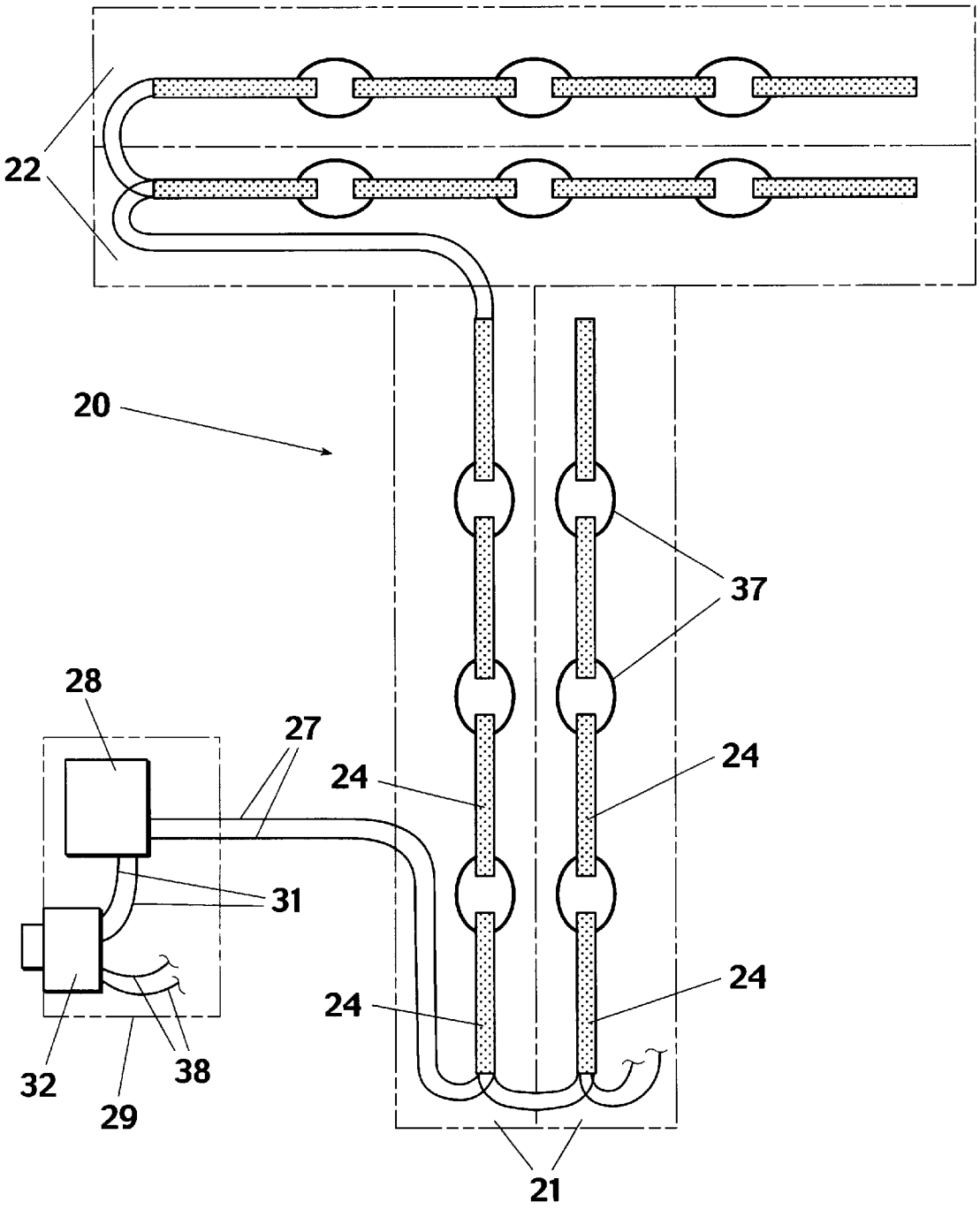
FIG. 4 is a schematic wiring diagram of the LED assembly of FIG. 2.

Turning to FIGS. 2, 3 and 4, a bracket type LED assembly 20 is illustrated for mounting in the enclosure 11 of the sign 10 of FIG. 1. As shown, to illuminate the translucent face 16 of the letter T, base track moldings 21 are connected to cross track moldings 22 by brackets 23 at their intersection. As can best be seen in FIG. 3, the track moldings 21 and 22 are preferably arranged in back-to-back abutment so that, with the LED boards 24 disposed in the channels of the moldings 21 and 22, the LED's 25 extend outwardly on opposite sides of the moldings 21 and 22. However, it may be desirable to direct the LED's rearwardly, forwardly or in any direction depending on the application. Furthermore, as shown in FIG. 3, the moldings 21 and 22 can be arranged in layers, depending upon the amount of illumination desired. A typical LED board 24 might employ twenty-four LED's per foot. Thus, illumination levels can be increased by either increasing the number of LED's per foot or by layering the boards as shown. In addition to the intersection brackets 23, the moldings 21 and 22 are also secured by brackets 26 at their extremities. As shown, the extremity brackets 26 extend to the peripheral walls 13 of the base enclosure 11 of the sign 10. The circuits of the LED boards 24 are connected by wires 27 to the low voltage terminals of a transformer 28 contained in a housing 29. The housing 29 is physically connected to the moldings 21 by a housing bracket 30 on which the transformer 28 and the housing 29 are mounted. The high voltage terminals of the transformer 28 are sometimes, but not always, connected by wires 31 to an outdoor power switch 32 which, in the case of a retrofit application, is often already mounted on the peripheral wall 13 of the base enclosure 11 of the sign 10. For most applications, the transformer 28 will convert 120 volts A.C. input to 24 volts A.C. output. This may vary depending on the particular application. Generally, the wires extending from the LED boards 24 to the low voltage terminals of the transformer 28 will be protected in a shrink tubing 33. As shown, the intersection brackets 23 may be secured by use of sheet metal screws 34, though any suitable alternative method such as the use of double back tape, epoxy glue or pop rivets may also be employed. Similarly, the extremity brackets 26 may be fastened to the base enclosure 11 of the sign 10 by use of sheet metal screws 35 or other suitable means. Finally, the transformer 28 and housing 29 may be secured to the housing bracket 30 by sheet metal screws 36 or by any other suitable attachment method. The circuits of the LED boards 24 may be interconnected by the use of electrical conductors or wires 37 or by the use of boards having connectors integrally mounted thereon. To install the bracket type LED assembly 20 in a base enclosure 11 of a sign 10, all that is necessary is to insert the single piece or integrated unit into the base enclosure 11 and to secure the extremity brackets 26 to the base enclosure 11. If a switch 32 is used, the wires 31 from the high voltage terminals of the transformer 28 are connected to the switch 32. The transformer 28, or the switch 32 if one is used, is then connected by wires 38 to the source, typically 120 volts A.C. The extremity brackets 26 have been thus identified so as to facilitate reference to those brackets in relation to the track molding configuration illustrated in the drawings. However, those brackets are not necessarily located at the extremities of the moldings and may be positioned wherever convenience suggests in a particular application. Furthermore, in some applications, those brackets may be fixed to the back wall 12 rather than the peripheral wall 13 of the base enclosure 11 of the sign 10. However, especially in the case of retrofits, the connection to side walls 13 is generally most convenient. Finally, the switch 32 is often, but not necessarily, already mounted on the peripheral wall 13 of the base enclosure 11 of the sign 10. If this is not the case, the switch 32 may be mounted on the housing 29 and an opening cut in the peripheral wall 13 to permit access to the switch 32.

Figure 5:
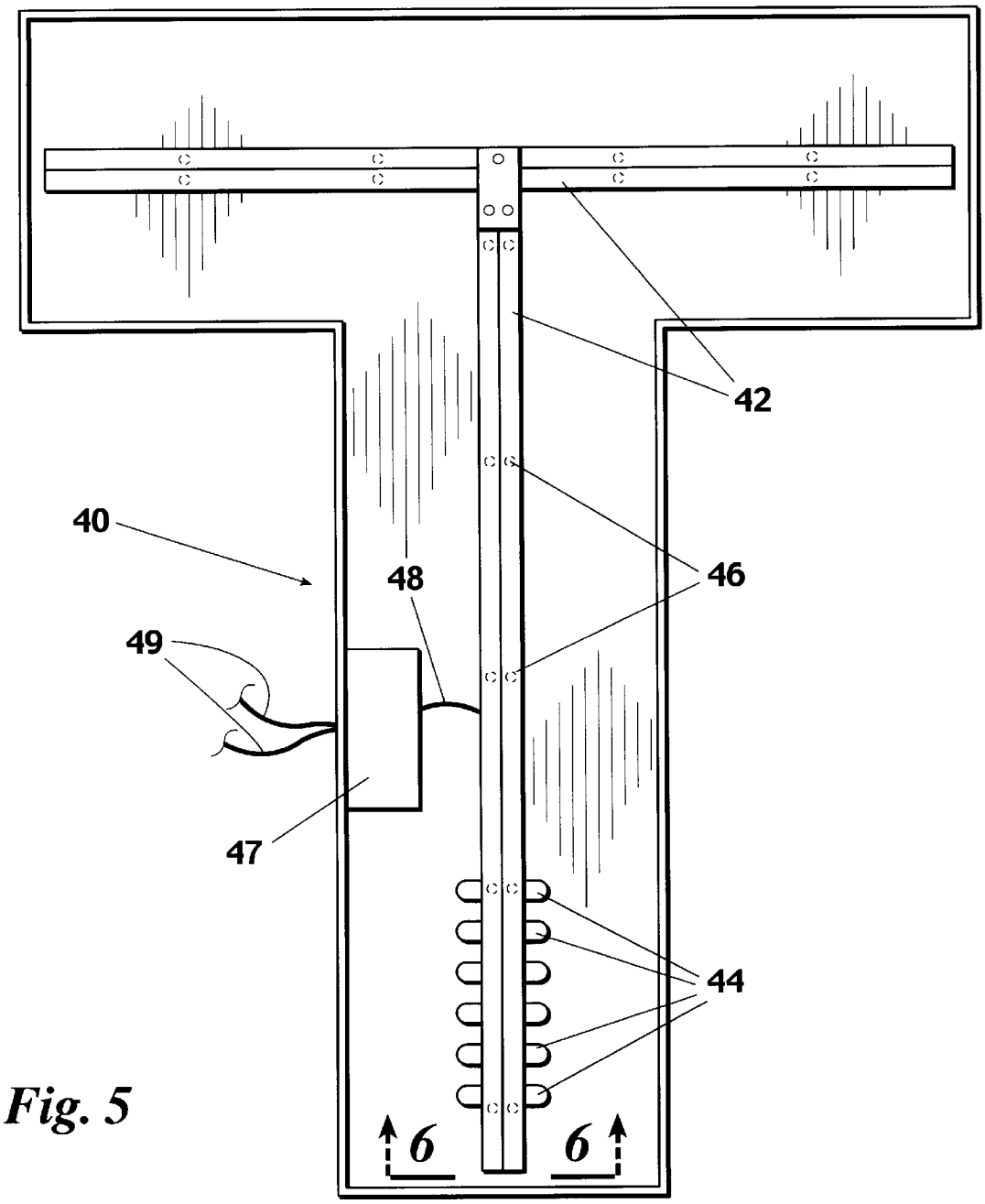
FIG. 5 is a front elevation view of a stencil-type embodiment of an LED assembly of the present invention for use with the sign of FIG. 1.
Figure 6:
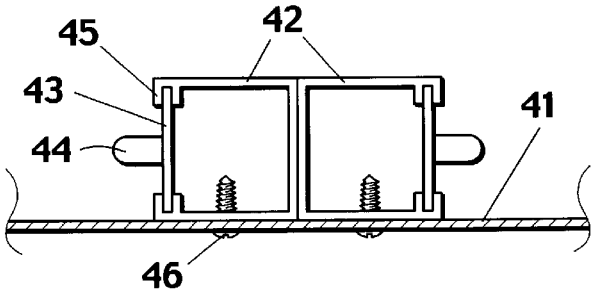
FIG. 6 is a sectional view taken along the line 6—6 of FIG. 5.

Turning now to FIGS. 5 and 6, a stencil type LED assembly 40 is illustrated. The perimeter of the base enclosure 11 or of the translucent cover 14 of many signs 10 is cut by use of a machine employing electronic data determining the shape of the piece. In making an LED assembly for new signs or to retrofit old signs made by use of such computerized data, it is most convenient to use that data to generate a stencil 41 which is proportionately smaller than the back wall 12 of the base enclosure 11 of the sign 10. The track molding 42 is then secured against the stencil 41 with the LED boards 43 positioned to direct the LED's 44 in parallel arrangement with respect to the stencil 41. As can best be seen in FIG. 6, with the LED boards 43 disposed in the molding channels 45, there is still room within the molding 45 to secure the molding 45 to the stencil 41 by the use of sheet metal screws 46. Other methods may also be used to secure the molding 45 to the stencil 41. The housing 47 and the transformer (not shown) are secured in suitable fashion directly to the stencil 41 with wires 48 connecting the circuits of the LED boards 43 to the low voltage terminals of the transformer (not shown) and wires 49 extending from the high voltage terminals of the transformer (not shown) through the housing 47 for ultimate connection to a switch (not shown) on the enclosure 11 of the sign 10. The stencil 41 provides an excellent base for the one piece or integrated assembly 40 which can be seated in its parent enclosure 11 and secured by screws, epoxy glue, double backed adhesive strips or other suitable fastening means.

The integrated unit, whether of the bracket or stencil type, may be secured to the peripheral wall or to the back wall of the sign enclosure, or both. The track molding sections can be arranged in any configuration suitable for insertion into the sign enclosure and for dispersion of light adequately to illuminate the translucent face.

Thus, it is apparent that there has been provided, in accordance with the invention, a LED assembly for illuminated signs that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An assembly for illuminating a sign having an alpha numeric/graphic-shaped enclosure covered by a translucent panel comprising:

an alpha numeric/graphic-shaped flat stencil imaging the alpha numeric/graphic-shaped enclosure and concentrically insertable therein;

a plurality of elongated track molding sections arranged in a configuration imaging said stencil and concentrically fastened to said stencil, each said molding section having opposed channels extending along a length thereof;

a plurality of circuit boards, each said molding section having at least one said circuit board disposed in said opposed channels, each said circuit board electrically connecting a plurality of LEDs mounted thereon; and means electrically connecting all of said LEDs into a single circuit.

2. An assembly according to claim 1, said stencil being proportionately smaller than said translucent panel.

3. An assembly according to claim 1, said stencil being formed by use of electronic data defining a configuration of the translucent surface.

4. An assembly according to claim 1, said stencil being formed by use of electronic data defining a configuration of the enclosure.

* * * * *